US008356498B1

(12) United States Patent
Gotta

(10) Patent No.: US 8,356,498 B1
(45) Date of Patent: Jan. 22, 2013

(54) DOUBLE LOCK HANDCUFF

(75) Inventor: Joseph Gotta, Ludlow, MA (US)

(73) Assignee: Universal Tool Company, Springfield, MA (US)

( * ) Notice: Subject to any disclaimer, the term of this patent is extended or adjusted under 35 U.S.C. 154(b) by 0 days.

(21) Appl. No.: 13/301,925

(22) Filed: Nov. 22, 2011

(51) Int. Cl.
*E05B 75/00* (2006.01)

(52) U.S. Cl. ..... 70/16

(58) Field of Classification Search ..... 70/15–17
See application file for complete search history.

(56) References Cited

U.S. PATENT DOCUMENTS

| | | | | |
|---|---|---|---|---|
| 268,171 | A | 11/1882 | Bean | |
| 870,871 | A | 11/1907 | Eggleton | |
| 1,732,225 | A | 10/1929 | Hoglund | |
| 1,806,163 | A | 5/1931 | Hoglund | |
| 1,845,511 | A | 2/1932 | Neal | |
| 2,390,885 | A * | 12/1945 | Kelley | 70/16 |
| 4,287,731 | A | 9/1981 | Kruger | |
| 4,574,600 | A | 3/1986 | Moffett | |
| 4,694,666 | A | 9/1987 | Bellingham et al. | |
| 4,697,441 | A | 10/1987 | Allen | |
| 5,106,586 | A | 4/1992 | Muszak et al. | |
| 5,463,884 | A | 11/1995 | Woo et al. | |
| 5,743,117 | A | 4/1998 | Woo et al. | |
| 5,797,284 | A | 8/1998 | Lurie | |
| 6,457,804 | B1 | 10/2002 | Scholz et al. | |
| D465,720 | S | 11/2002 | Persson | |
| 6,574,998 | B2 | 6/2003 | Kwon | |
| 6,619,077 | B1 | 9/2003 | Robinson | |
| 6,851,284 | B2 | 2/2005 | Kim et al. | |
| 7,251,964 | B2 | 8/2007 | Wade | |
| 7,900,324 | B2 | 3/2011 | Ginocchio | |
| 2002/0189303 | A1 * | 12/2002 | Kwon | 70/16 |
| 2004/0237604 | A1 * | 12/2004 | Kim et al. | 70/16 |
| 2006/0130538 | A1 * | 6/2006 | Wade | 70/16 |
| 2007/0163308 | A1 | 7/2007 | Piane | |
| 2010/0206017 | A1 | 8/2010 | Garibaldi | |
| 2011/0232338 | A1 | 9/2011 | Huang et al. | |

FOREIGN PATENT DOCUMENTS

| | | |
|---|---|---|
| FR | 2848596 | 6/2004 |

* cited by examiner

*Primary Examiner* — Lloyd Gall
(74) *Attorney, Agent, or Firm* — Doherty Wallace Pillsbury Murphy, P.C.

(57) ABSTRACT

A handcuff comprising a bolt and a bolt spring which work in combination to double lock the handcuff. The bolt comprises an underside having teeth which are engagable with the teeth of a jaw. The underside of the bolt further comprises a groove through which a stud disposed on a cheek head of the handcuff is positioned to thereby further secure the bolt in position when the handcuff is locked. The bolt further comprises an upper side comprising a groove, a ridge, and a detent. The bolt spring comprises a body bent to form a side wall which bridges a first spring leg portion to a second spring leg portion, wherein the first and second spring leg portions engage with the upper side of the bolt to hold the bolt spring in a first position.

10 Claims, 6 Drawing Sheets

DOUBLE LOCK HANDCUFF

BACKGROUND TO THE INVENTION

1. Field of the Invention

The present invention relates to handcuffs for locking about the wrists of an individual. More particularly, the invention relates to a handcuff having an improved double lock assembly.

2. Background of the Invention

Many different designs for handcuffs have been proposed and constructed in the past including those which feature in each handcuff a double lock assembly. In such conventional constructions, the ends of a pair of arcuate elements known as a cheek and jaw are pivotally coupled to one another. The cheek and jaw are pivotable toward and away from one another between handcuff locked and unlocked positions. A spring biased bolt is also conventionally carried by the cheek. The bolt carries teeth which engage in ratchet-like-manner with teeth carried by the jaw upon closing the jaw into the cheek to close the handcuff. The meshing teeth prevent relative movement of the cheek and jaw away from one another and opening of the handcuff.

In U.S. Pat. No. 2,390,885, a double locking assembly is used to prevent the bolt from being lifted from the jaw and against the spring bias applied thereto. Thus, the bolt is maintained in latched engagement with the jaw notwithstanding efforts to lift the bolt from such latching engagement without the aid of a key for the handcuff.

SUMMARY OF THE INVENTION

The double lock handcuffs of the prior art are improved upon by a handcuff comprising a generally arcuate jaw having teeth at a first end thereof and a second end oppositely situated from the first end; a generally arcuate cheek having a cheek head on a first end thereof and an oppositely situated second end, wherein the second end of the arcuate cheek is pivotally coupled to the second end of the generally arcuate jaw to enable relative pivotal movement of the cheek and the jaw toward and away from one another between handcuff closed and open positions, respectively; a frame which abuts the cheek head, wherein the frame comprises an underside flanked on a first end thereof by a first interior side wall and flanked on an oppositely situated second end thereof by a second interior side wall; a cavity formed between the underside, the first interior lateral side, the second interior lateral side, and the cheek head; a stud disposed on the cheek head which protrudes into the cavity; and a bolt and a bolt spring which cooperate with one another to lock and to unlock the handcuff.

In an exemplary embodiment, the bolt comprises an underside having teeth which are engaged with the teeth of the generally arcuate jaw when the handcuff is in a locked position, and a groove formed through the underside and through which the stud is positioned when the handcuff is in the locked position, and from which the stud is removed when the handcuff is in an unlocked position. The bolt further comprises an upper side opposite to the underside, wherein the upper side comprises a groove formed therethrough, a ridge having a leading edge which overlies a portion of the groove of the upper side, and a detent.

In an exemplary embodiment, the bolt spring comprises an elongated body bent to form a vertically extending side wall which bridges a first spring leg portion to a second spring leg portion, wherein the first spring leg portion engages with the detent of the bolt when the bolt spring is in a first position, and further wherein the second leg portion physically abuts the underside of the frame and the first interior side wall of the frame when the bolt is in the first position, and further wherein the second leg portion comprises a key pin engaging member.

In an exemplary embodiment, the handcuff further comprises a key pin disposed on the cheek head and extending therefrom into the cavity wherein the key pin is aligned with the key pin engaging member of the second spring leg portion and with the groove formed on the upper side of the bolt.

In an exemplary embodiment, when the key pin is rotated in a first direction, the key pin engages with the key pin engaging member thereby effectuating movement of the bolt spring in a linear direction towards the second interior side wall of the frame such that the bolt spring is in a second position. When the key pin is subsequently rotated in a second direction opposite to the first direction, the key pin engages with the leading edge of the ridge of the bolt thereby effecting the removal of the stud from the groove of the bolt, thereby effectuating the release of the teeth of the bolt from the teeth of the generally arcuate jaw.

Before explaining the exemplary embodiments of the invention in detail, it is to be understood that the invention is not limited in its application to the details of construction and to the arrangements of the components set forth in the following description or illustrated in the drawings. Rather, the invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

For a better understanding of the invention, its operating advantages and the specific objects attained by its uses, reference should be made to the accompanying drawings and descriptive matter in which there are illustrated preferred embodiments of the invention.

DETAILED DESCRIPTION OF THE INVENTION

Reference will now be made in detail to the preferred embodiment of the present invention, an example of which is illustrated in the accompanying drawings.

Figure 1:
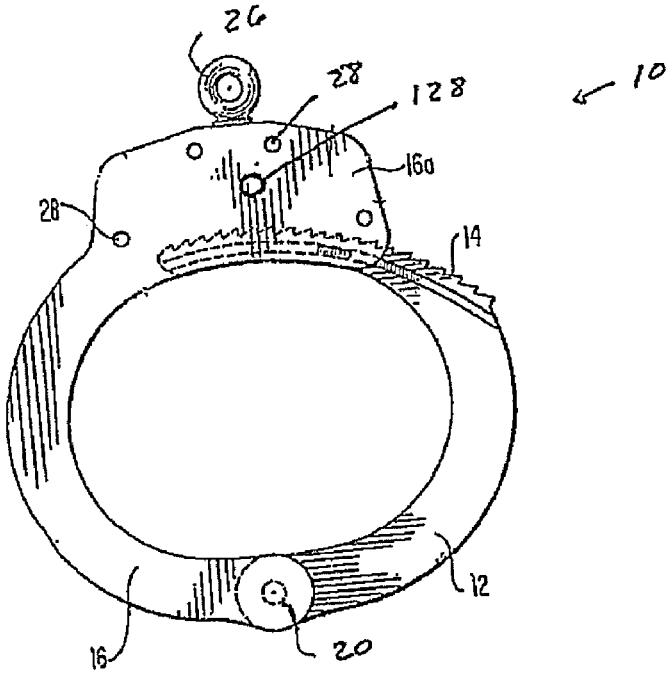
FIGS. 1 and 2 depict an exemplary handcuff.
Figure 2:
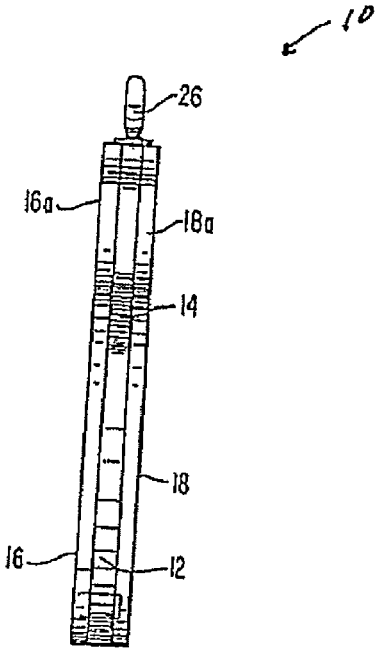
Figure 3:
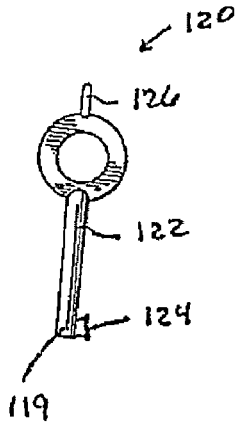
FIG. 3 depicts an exemplary key.

Referring now to FIGS. 1 and 2, there is illustrated an exemplary handcuff generally designated 10, it being appreciated that only one such handcuff normally comprising a pair thereof chained one to the other is described and illustrated herein. Handcuff 10 includes a generally arcuate jaw 12 having ratchet-like teeth 14 at one end, and pivotally connected at its opposite end between generally arcuate front and back cheeks 16 and 18, respectively.

Figure 6:
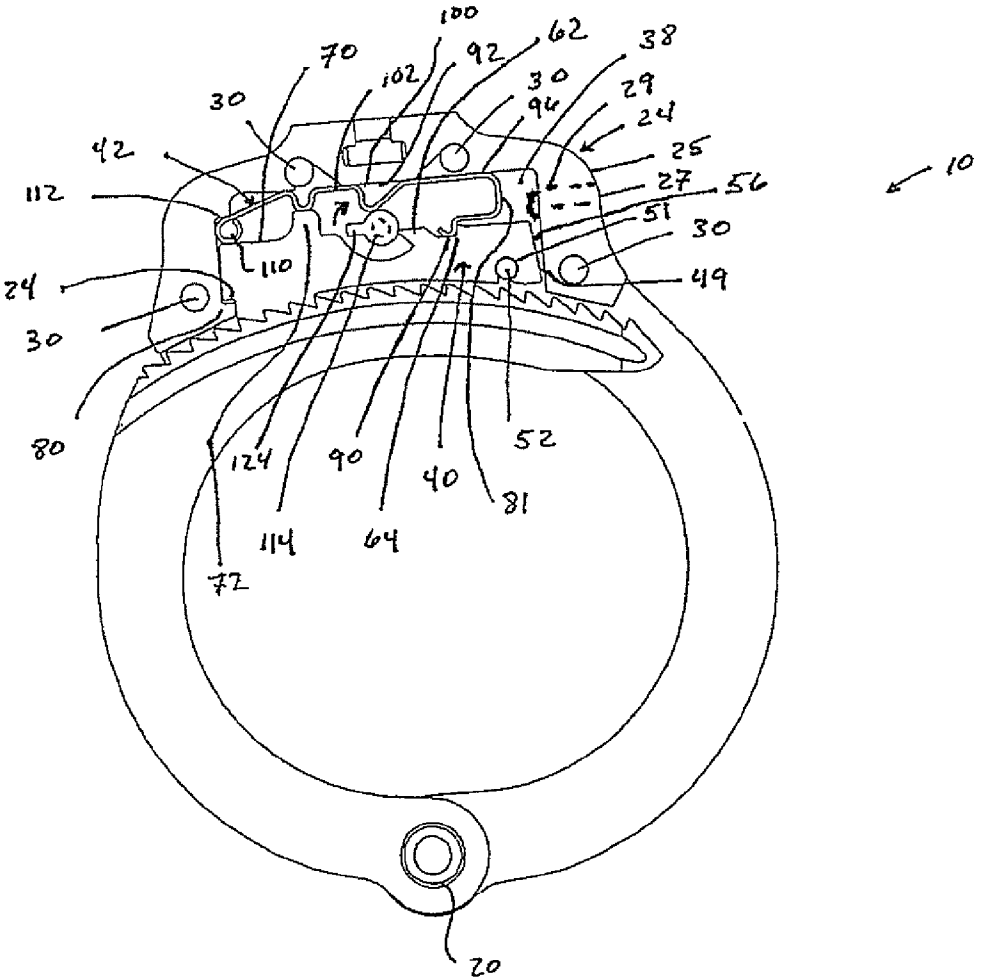
FIG. 6 depicts a fragmentary enlarged view of an exemplary handcuff with the front cheek removed and illustrating an exemplary lock assembly of the handcuff in a double locked condition.
Figure 7:
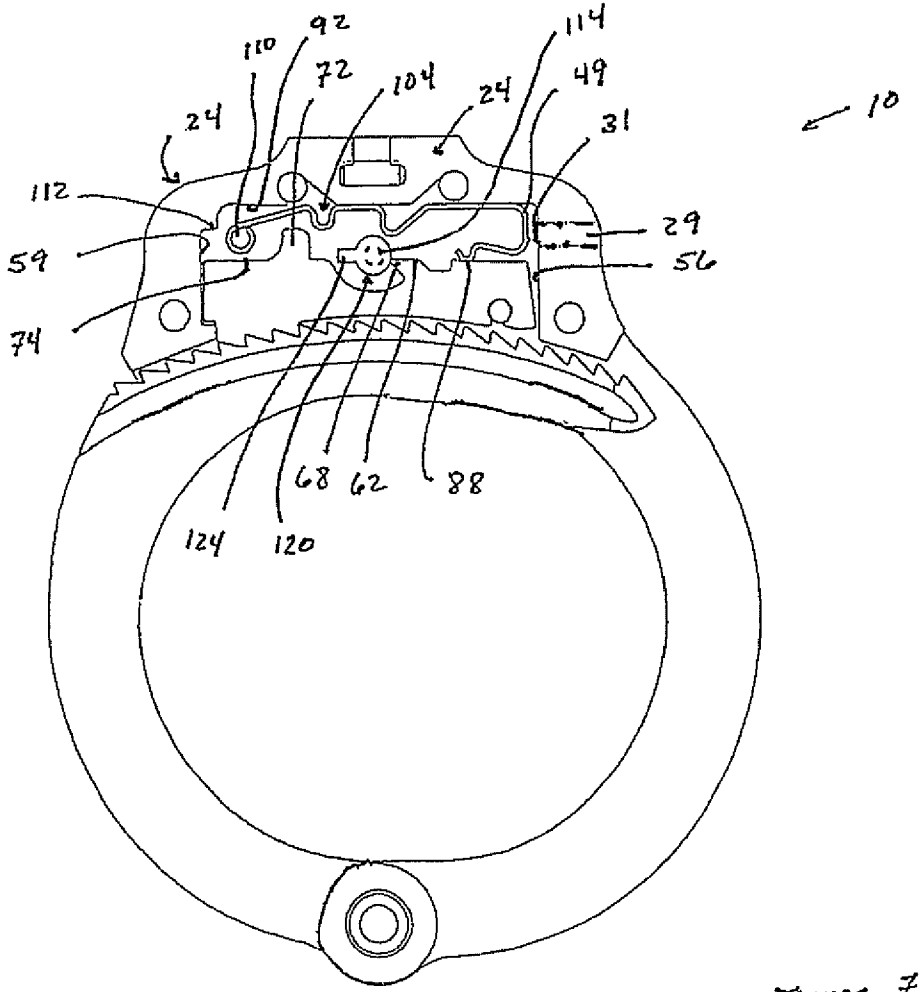
FIG. 7 depicts the handcuff depicted in FIG. 4 in which the exemplary lock assembly is in a single locked condition.

Cheeks 16 and 18 terminate at their opposite ends in enlarged heads 16*a* and 18*a* which form part of a lock assembly. The lock assembly includes a frame 24, preferably a metal plate, disposed between cheek heads 16*a* and 18*a*. As illustrated in FIGS. 6 and 7, frame 24 has the same general outline as cheek heads 16*a* and 18*a* which straddle frame 24. A swivel 26 may be secured to frame 24 and cheek heads 16*a* and 18*a* and may project therefrom for attachment to a chain (not shown) in a conventional manner.

To obtain increased strength in the construction of the lock assembly and the joining of cheek heads 16*a* and 18*a* and frame 24 one to the other, each cheek head 16*a* and 18*a* is provided with a plurality of inwardly extending bosses or protrusions 28 which are received in registering apertures 30 formed in frame 24. Frame 24 is formed to provide a recess along an underside 92 thereof and defines, with the sides of cheek heads 16*a* and 18*a*, a chamber or cavity 38 housing the working parts of the lock assembly. In final assembly, cheek heads 16*a* and 18*a* and frame 24 are aligned and brazed one to the other with the bosses 28 received in the registering apertures 30.

Figure 4:
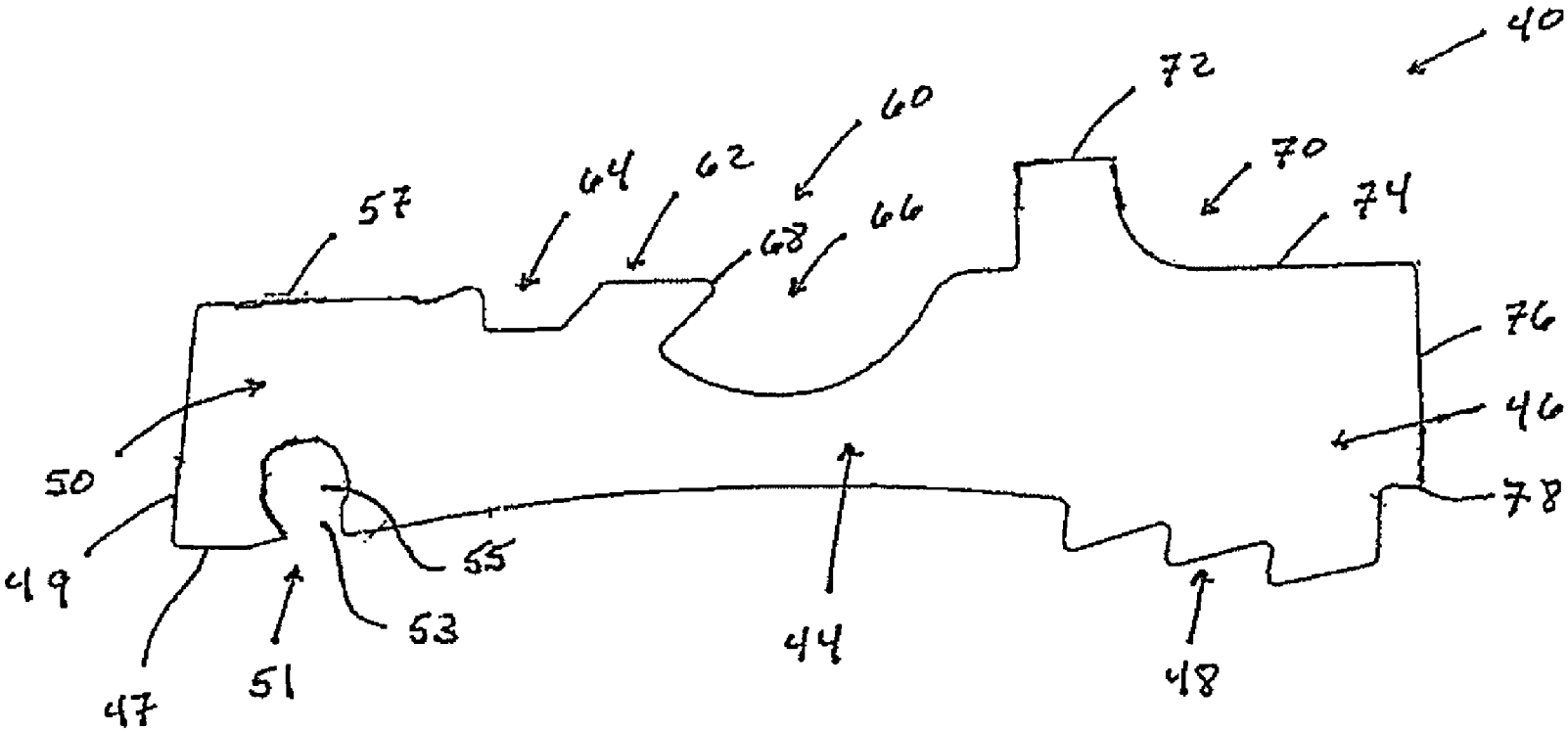
FIG. 4 depicts an exemplary bolt.
Figure 5:
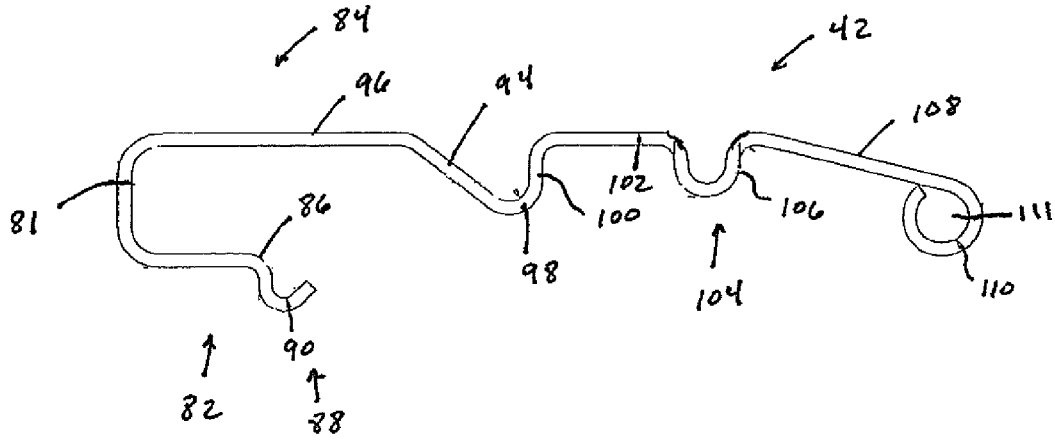
FIG. 5 depicts an exemplary bolt spring.

The lock assembly includes a bolt 40 and a bolt spring 42 both disposed in cavity 38. As most easily visible in FIG. 4, bolt 40 comprises an elongated shank 44, a head 46 having teeth 48 along its underside for engaging teeth 14 carried by jaw 12, and a foot 50 at an end remote from head 46. Foot 50 comprises a groove 51 formed on an underside 47 thereof, wherein groove 51 comprises a neck 53 formed on underside 47 of foot 50 and which extends towards an oppositely situated upper side 57 of foot 50 into a generally arcuate-shaped head 55.

In accordance with the present invention, bolt 40 is pivotally secured to cheeks 16*a* and 18*a* and frame 24 by a stud 52 secured between cheek heads 16*a* and 18*a*. Particularly, stud 52 is positioned within cavity 38 such that stud 52 is received within arcuate-shaped head 55 of groove 51 and can be removed from groove 51 via neck 53, and provides a pivotal support therefor. A rearward leading wall 49 of foot 50, which is adjacent to underside 47 of foot 50, assists, along with stud 52, in defining a bearing for foot 50 and about which bolt 40 pivots.

For reasons discussed hereinafter, an upper side 60 of shank 44 comprises a ridge 62 which is abutted by a detent 64 on one side thereof, and by a generally concave-shaped groove 66 on an opposite side thereof. Ridge 62 comprises a leading edge 68 which partially extends over generally concave-shaped groove 66. Furthermore, an upper side 70 of head 46 slopes upwardly from generally concave-shaped groove 66 to form a first abutment wall 72 which slopes downwardly at an opposite end to foiiu a second abutment wall 74. Second abutment wall 74 is joined to a forward leading wall 76 of head 46 at a substantially perpendicular angle, while a shoulder 78 is formed adjacent to forward leading wall 76 and to teeth 48 of head 46, wherein shoulder 78 engages with a recess 80 formed within frame 24 when handcuff 10 is in a locked position (see, e.g., FIG. 6).

Referring to FIGS. 5-8, bolt spring 42 comprises an elongated strip of metal reversely formed, e.g., bent, to form a vertically extending side wall 81 which bridges a first spring leg portion 82 to a second spring leg portion 84. When bolt spring 42 is disposed in cavity 38, first leg portions 82 bears against bolt 40 to bias it for pivotal movement in a clockwise direction tending to move the bolt into a locking position by having teeth 48 engaging with teeth 14 of jaw 12.

More particularly, first spring leg portion 82 is bent along a line 86 to create a bowed member 88 having an arcuate-shaped bottom wall 90 which is received within detent 64 of bolt 40 when groove 51 is engaged with stud 52. In this manner, linear movement of bolt spring 42 is prevented except when bolt spring 42 is moved by a key.

Second spring leg portion 84 bears against an underside 92 of frame 24 to further stabilize bolt spring 42 in position. More particularly, forward of bowed member 88, second spring leg portion 84 comprises a key pin engaging member comprising a sloped wall 94 which extends towards bowed member 88 from a longitudinally extending wall 96. Sloped wall 94 converges with a generally concave shaped wall 98 which then converges with a vertically extending wall 100 which extends from generally concave shaped wall 98 towards longitudinally extending wall 96.

At a point furthest away from generally concave shaped wall 98, vertically extending wall 100 turns forward of longitudinally extending wall 96 and converges with a longitudinally extending wall 102. At an end of longitudinally extending wall 102 opposite to vertically extending wall 100, longitudinally extending wall 102 converges with a generally U-shaped portion 104 which extends towards first spring leg portion 82 for engagement with first abutment wall 72 when handcuff 10 is in a locked position (see, e.g., FIG. 6). A forward leading leg 106 of U-shaped portion 104 converges with a sloped wall 108 which turns inward at its terminal end to form a generally annular shaped member 110 having a hole 111 formed therethrough which is directed towards first spring leg portion 82 and opposite to vertically extending side wall 81, and which abuts upper side 70 of head 46, and which also abuts a shoulder 112 formed within underside 92 of frame 24 when handcuff 10 is in a locked position.

Figure 8:
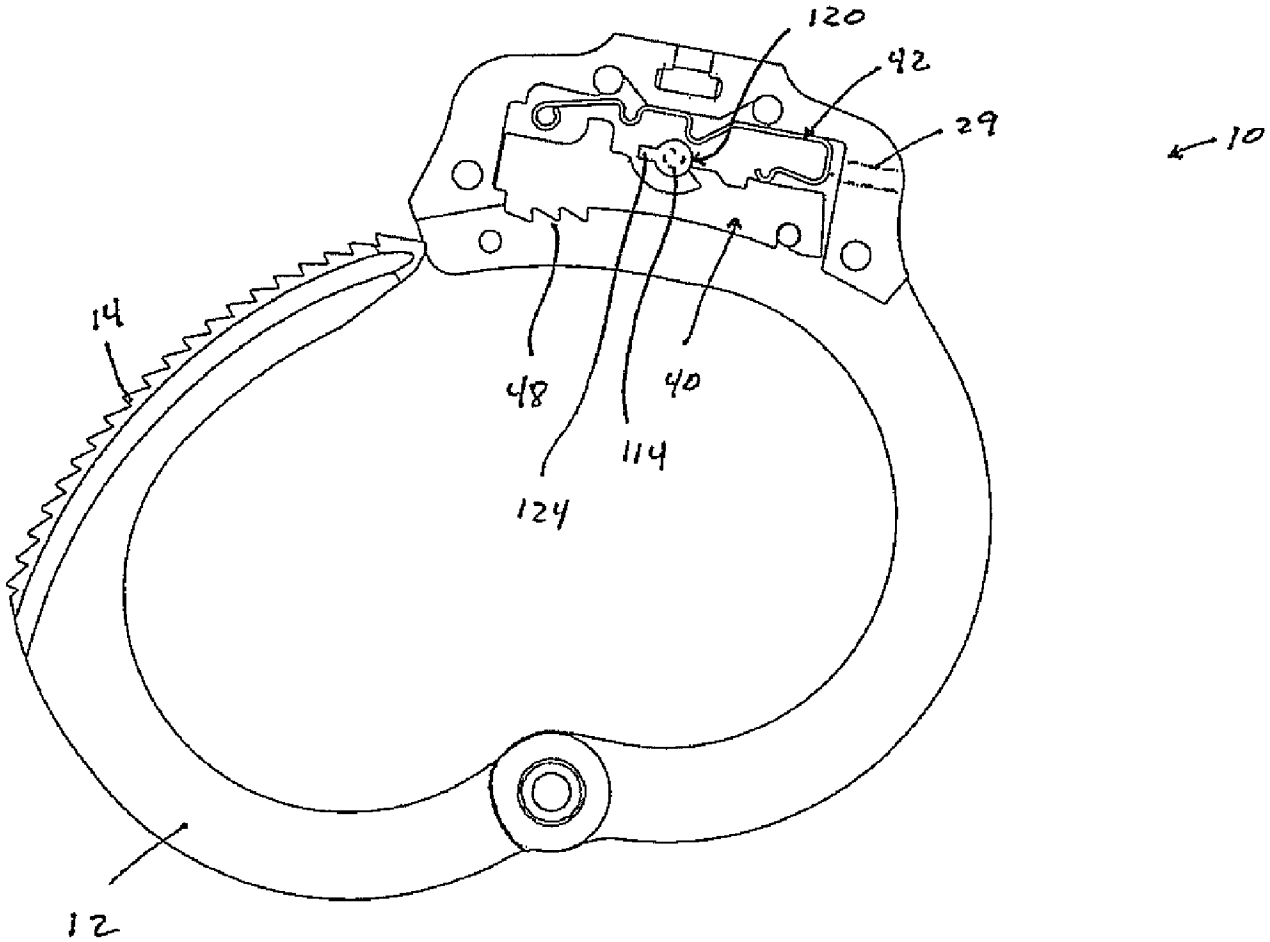
FIG. 8 depicts an unlocked handcuff in which the jaw is entering the locking assembly and moving toward a handcuff locked condition.

It will be appreciated from a review of FIGS. 6-8 that bolt spring 42 is carried for linear sliding movement lengthwise within cavity 38 between first and second positions, respectively. Particularly, bowed member 88 of first spring leg portion 82 is adapted to slide along upper side 57 of foot 50 of bolt 40. Bowed member 88 of leg portion 82 engages with detent 64 of foot 50 in the first position (see, e.g., FIG. 6), while U-shaped portion 104 of bolt spring 42 engages with first abutment wall 72 in the first position, and generally annular shaped member 110 engages with shoulder 112 and with upper side 70 of head 46 in the first position, to prevent linear sliding movement of bolt spring 52 without the handcuff key as by application of impact forces to the handcuff. Additionally, groove 51 of bolt 40 engages with stud 52 in the second position (see, e.g., FIG. 7) for the same purpose. In this way, bolt spring 42 may be moved only by the key, and the handcuffs avoid the undesirable need to move bolt spring 42 to the first position prior to handcuffing a subject. Second spring leg portion 84 is slidable along underside 92 of frame 24, the opposite ends of bolt spring 42 butting the ends of frame 24 and defining the end limits of its linear displacement.

Referring now to FIGS. 1, 3, and 6-8, there is provided a key 120 having a shank 122 with a radial projection 124 at one end and an axial projection or pin 126 at an oppositely situated terminal end 119. The end of key 120 carrying radial projection 124 is axially recessed for engagement about a key pin 114 which is centrally positioned within cavity 38. Key pin 114 is secured to cheek head 18*a* and projects across cavity 38 into a key opening 128 formed in cheek head 16*a*. A lateral side 25 of frame 24 which is nearest to foot 50 of bolt 40 has an aperture 27 formed therethrough, wherein a pin 29 is slidably disposed therein such that a head 31 of pin 29 protrudes towards rearward leading wall 49 of bolt 40 from a first interior side wall 56 of frame 24, wherein first interior side wall 56 is oppositely situated to a second interior side wall 59 of frame 24. Axial projection 126 is configured to engage with an end of pin 29 opposite to head 31 such that when a directional force is transferred from axial projection 126 to head 31, bolt spring 42 is linearly displaced from the position depicted in FIG. 7 to the position depicted in FIG. 6.

To close handcuff 10 hereof, jaw 12 is moved toward and its free end is moved between cheeks 16 and 18. Teeth 14 of jaw 12 slides past teeth 48 of head 46 in a ratchet-like manner. When handcuff 10 is fully closed, bolt 40 is biased by bolt spring 42 to maintain the engagement of teeth 48 of bolt 40 with teeth 14 of jaw 12 thus locking handcuff 10 in its closed position and preventing movement of jaw 12 away from cheeks 16 and 18. This action provides a single lock for handcuff 10 as shown in FIG. 7.

To double lock handcuff 10 hereof in its closed position (as shown in FIG. 6), bolt spring 42 is linearly displaced from a first position illustrated in FIG. 7 to a second position illustrated in FIG. 6. To accomplish this, axial projection 126 on key 120 is inserted through aperture 27 and pushes against pin 29 wherein pin 29 thereby engages bolt spring 42, and, more specifically, thereby asserts a directional force against vertically extending side wall 81 of bolt spring 42 such that bolt spring 42 moves linearly along cavity 38 into the position illustrated in FIG. 6. In this closed position, bowed member 88 of first spring leg portion 82 is located in registry with detent 64 of bolt 40. Additionally, U-shaped portion 104 of second spring leg portion 84 abuts first abutment wall 72 of bolt 40, while generally annular shaped member 110 of second leg portion 84 abuts shoulder 112 of frame 24 and upper side 70 of head 46, and while longitudinally extending walls 96 and 102 abut underside 92 of frame 24. In this position, generally concave shaped wall 98 of the key pin engaging member of bolt spring 42 is aligned with key pin 114. This position prevents bolt 40 from pivoting toward an unlocked position with teeth 48 disengaged from teeth 14. Thus, the bias of spring 42 serves to maintain bolt 40 in the handcuff locked position illustrated in FIG. 6 while the engagement of longitudinally extending walls 96 and 102 with underside 92 of frame 24 and the engagement of groove 51 with stud 52 prevent bolt 40 from pivoting from its locking position vis-a-vis jaw 12 toward its unlocked position illustrated in FIG. 7. Thus, spring 42 serves as a double lock for handcuff 10.

To unlock handcuff 10 and enable jaw 12 and cheeks 16 and 18 to pivot about stud 20 in a direction away from one another, key 120 is inserted into key opening 128 and contacted with key pin 114. By rotating key 120, for example, in a clockwise direction as indicated by the arrow in FIG. 6, radial projection 124 of key 120 engages vertically extending wall 100. Upon continued rotation of key 120 in that direction, bolt spring 42 is linearly displaced, for example, from left to right as illustrated in FIG. 6, into the position illustrated in FIG. 7. This latter linear displacement misaligns bowed member 88 of first spring leg portion 82 with detent 64 of bolt 40 such that vertically extending side wall 81 of bolt spring 42 moves towards lateral side 25 of frame 24. This linear movement in turn causes misalignment of U-shaped portion 104 from first abutment wall 72, and further causes movement of generally annular shaped member 110 away from shoulder 112 such that it registers between second abutment wall 74 and underside 92 of frame 24, but does not physically abut these structures. During and after this displacement of bolt spring 42, first and second longitudinally extending walls 96 and 102 remain in physical abutment with underside 92, while stud 52 remains in groove 51, thereby holding bolt 40 in position.

Thus, while the additional detenting action is removed, the bias of bolt spring 42, along with the resistance force generated by the engagement of stud 52 with groove 51 of bolt 40, urges bolt 40 into engagement with jaw 12 to maintain the handcuff in its locked condition. Once spring 42 is displaced to the right as described, key 120 may then be rotated in the opposite direction, e.g., counterclockwise, to bring radial projection 124 of key 120 into engagement with leading edge 68 of ridge 62 of bolt 40. Continued rotation of key 120 in such a direction lifts or pivots bolt 40 to remove teeth 48 from engagement with teeth 14. Thus, jaw 12 is free for movement away from cheeks 16 and 18 whereby handcuff 10 may be opened as shown in FIG. 8. In the course of double locking and unlocking bolt spring 42, key 120 exerts sufficient force to overcome the frictional resistance between detent 64 and bowed member 88 of bolt spring 42, between U-shaped portion 104 of bolt spring 42 and first abutment wall 72 of bolt 40, and between stud 52 and groove 51 of bolt 40.

Consequently, it will be appreciated that the objects of the present invention are fully accomplished in that there has been provided in the foregoing described handcuff construction a bolt spring which serves a dual purpose. First, bolt spring 42 serves to bias bolt 40 into locking engagement with jaw 12 thus locking handcuff 10 in its closed position. This single locking action is, of course, sufficient to lock handcuff 10 in its closed position, but if greater security is desired, bolt spring 42 can be displaced in the manner described and illustrated. Thus, bolt spring 42 serves also to double lock the handcuff. The foregoing is also provided utilizing a minimum number of parts in its construction and operation, and is configured to provide great structural support and integrity than has here before been achieved.

It will be apparent to those skilled in this art that various modifications could be made in the handcuff hereof without departing from the scope or spirit of the invention.

What is claimed is:

1. A handcuff comprising:

a generally arcuate jaw having teeth at a first end thereof and a second end oppositely situated from the first end;

a generally arcuate cheek having a cheek head on a first end thereof and an oppositely situated second end, wherein the second end of the arcuate cheek is pivotally coupled to the second end of the generally arcuate jaw to enable relative pivotal movement of the cheek and the jaw toward and away from one another between handcuff closed and open positions, respectively;

a frame which abuts the cheek head, wherein the frame comprises an underside flanked on a first end thereof by a first interior side wall and flanked on an oppositely situated second end thereof by a second interior side wall;

a cavity formed between the underside, the first interior side wall, the second interior side wall, and the cheek head;

a stud disposed on the cheek head which protrudes into the cavity;

a bolt and a bolt spring which cooperate with one another to lock and to unlock the handcuff, wherein the bolt comprises:

an underside having teeth which are engaged with the teeth of the generally arcuate jaw when the handcuff is in a locked position, and a groove formed through the underside and through which the stud is positioned when the handcuff is in the locked position, and from which the stud is removed when the handcuff is in an unlocked position; and an upper side opposite to the underside, wherein the upper side comprises a groove formed therethrough, a ridge having a leading edge which overlies a portion of the groove of the upper side, and a detent;

and wherein the bolt spring comprises:

an elongated body bent to form a vertically extending side wall which bridges a first spring leg portion to a second spring leg portion, wherein the first spring leg portion engages with the detent of the bolt when the bolt spring is in a first position, and further wherein the second leg portion physically abuts the underside of the frame and the second interior side wall of the frame when the bolt spring is in the first position, and further wherein the second leg portion comprises a key pin engaging member;

a key pin; and a key, wherein the key engages with the key pin such that when the key is rotated in a first direction, the key engages with the key pin engaging member thereby effectuating movement of the bolt spring in a linear direction towards the first interior side wall of the frame such that the bolt spring is in a second position, and wherein when the key is subsequently rotated in a second direction opposite to the first direction, the key engages with the leading edge of the ridge of the bolt thereby effecting the removal of the stud from the groove of the bolt, thereby effectuating the release of the teeth of the bolt from the teeth of the generally arcuate jaw.

2. The handcuff of claim 1, wherein the key pin engaging member comprises a concave shaped wall which is coterminous with a sloped wall on one side thereof, and coterminous with a vertically extending wall on an opposite side thereof, wherein the key engages the vertically extending wall to effectuate the linear movement of the bolt spring to the second position.

3. The handcuff of claim 1, wherein:

the second spring leg portion further comprises a detent; and the upper side of the bolt further comprises a first abutment member disposed adjacent to the groove of the upper side of the bolt and oppositely situated from the detent of the bolt;

wherein the detent of the second spring leg portion is engaged with the first abutment member when the bolt spring is in the first position and is disengaged therefrom when the bolt spring is in the second position.

4. The handcuff of claim 3, wherein the detent of the second spring leg portion comprises a generally U-shaped member directed towards the first spring leg portion.

5. The handcuff of claim 3, wherein:

the second spring leg portion further comprises a generally annular shaped member formed at a terminal end thereof; and the upper side of the bolt further comprises a second abutment member;

wherein the generally annular shaped member is engaged with the second abutment member and with the second interior side wall of the frame when the bolt spring is in the first position, and is disengaged therefrom when the bolt spring is in the second position.

6. The handcuff of claim 5, wherein the second abutment member is coterminous with the first abutment member which is disposed between the second abutment member and the groove of the upper side of the bolt.

7. The handcuff of claim 5, wherein the second spring leg portion further comprises:

a first longitudinally extending wall coterminous with the detent of the second spring leg portion and with the key pin engaging member; and a second longitudinally extending wall coterminous with the key pin engaging member on an end thereof opposite to the first longitudinally extending wall and with the vertically extending side wall;

wherein the first and second longitudinally extending walls abut the underside of the frame when the bolt spring is in the first position and in the second position.

8. The handcuff of claim 7, wherein the second spring leg portion further comprises a sloped wall coterminous with the generally annular shaped member at a first terminal end thereof, and is coterminous with the detent of the second spring leg portion at a second terminal end thereof, wherein the second terminal end of the sloped wall abuts the underside of the frame when the bolt spring is in the first position.

9. The handcuff of claim 8, wherein the first spring leg portion comprises a bowed member having a generally concave shape, wherein the bowed member fits within the detent of the bolt to hold the bolt spring in the first position.

10. The handcuff of claim 9, further comprising a pin which is slidably engaged with the first interior side wall of the frame, wherein, when the bolt spring is in the second position, the pin engages with the vertically extending side wall of the bolt spring to thereby effectuate the linear movement of the bolt spring to the first position.

* * * * *